United States Patent [19]

Asami et al.

[11] 4,128,102

[45] Dec. 5, 1978

[54] INCORRECT COIN STACKING DETECTING DEVICE IN A COIN PACKAGING MACHINE

[75] Inventors: Kazuto Asami; Hirokuni Matono, both of Himeji, Japan

[73] Assignee: Glory Kogyo Kabushiki Kaisha, Himeji, Japan

[21] Appl. No.: 829,093

[22] Filed: Aug. 30, 1977

[30] Foreign Application Priority Data

Sep. 2, 1976 [JP] Japan ..... 51-117888[U]

[51] Int. Cl.[2] ..... G07D 9/04

[52] U.S. Cl. ..... 133/1 A

[58] Field of Search ..... 133/1 A, 8 R–8 D; 53/78, 254

[56] References Cited

U.S. PATENT DOCUMENTS 4,040,434 8/1977 Watanabe et al. ..... 133/1 A

FOREIGN PATENT DOCUMENTS 1321209 6/1973 United Kingdom ..... 133/1 A

*Primary Examiner*—Allen N. Knowles

[57] ABSTRACT

In a coin packaging machine, a coin stacking cylinder is formed with positive terminal boards, negative terminal boards, and insulating boards which extend in the axial direction of the cylinder in such a manner that one insulating board is interposed for every pair of positive and negative terminal boards. These boards are movably supported so as to change the inside diameter of the cylinder according to the outside diameter of coins to be packaged.

3 Claims, 6 Drawing Figures

INCORRECT COIN STACKING DETECTING DEVICE IN A COIN PACKAGING MACHINE

BACKGROUND OF THE INVENTION

This invention relates to coin packaging machines, and more particularly to an improvement of an incorrect coin stacking detecting device in such a coin packaging machine, which detects an incorrect stacking condition of coins stacked to be wrapped with a wrapping paper.

In general, in the case where a plurality of coins are stacked to be packaged, a predetermined number of coins are successively supplied into a coin stacking cylinder whose inside diameter is slightly larger than the outside diameter of the coins, by vibrating the coin stacking cylinder the coins are stacked in a predetermined stacking state in which the coins are in close contact with each other and form one cylinder, and the cylindrical stack of coins thus obtained is wrapped with a paper. If the coins were not stacked in the predetermined stacking state, the stack of coins would collapse while being brought to a coin packaging mechanism or being packaged thereby.

Even if the above-described coin stacking cylinder is used, the coins are not always correctly stacked depending on the position of a coin taken when supplied thereinto or the deformation of a coin. More specifically, in such a case the coin is often held upright or caught in the coin stacking cylinder (which will be referred to as "a coin standing" when applicable).

If this coin standing occurs, the height of stacked coins per predetermined number of pieces thereof is naturally increased. Accordingly, a conventional coin packaging machine is provided with a detector for detecting the height of stacked coins, and if the height exceeds a predetermined value, the stacked coins are rejected as incorrectly stacked coins.

However, as the height of stacked coins depends on its denomination, the reference height must be changed whenever the denomination is changed.

The incorrect stacking state further includes the case where coins are stacked but staggered horizontally. This is caused mainly by the bend or curve of the coin or coins, and cannot be corrected even if the coin stacking cylinder is vibrated. This incorrect stacking state cannot be detected by the conventional detector adapted to detect the height of stacked coins.

SUMMARY OF THE INVENTION

Accordingly, it is an object of this invention is to eliminate the above-described drawbacks accompanying a conventional coin packaging machine.

More specifically, an object of the invention is to provide an incorrect coin stacking detecting device in a coin packaging machine operating to stack a predetermined number of coins and to wrap the stack of coins with a wrapping paper, in which the stagger of at least one of the coins stacked is detected so that the incorrect stacking state of the coins can be positively detected and the coins are rejected before packaged, a trouble such as a collapse of the stacked coins is prevented, and it is applicable to the packaging of a stack of coins whose height depends on its denomination.

The foregoing object and other objects of the invention have been achieved by the provision of an incorrect stacking detecting device in a coin packaging machine of the type that after a predetermined number of coins fed into a coin stacking cylinder are stacked in a predetermined stacking state, a wrapping paper is wrapped around the stack of coins, in which device the coin stacking cylinder is provided with a plurality of terminal boards electrically insulated from one another, the terminal board being arranged on the inner wall of the coin stacking cylinder in such a manner that the terminal boards extend in the axial direction of the coin stacking cylinder and are connected to an electric source so that adjacent terminal boards are opposite in polarity.

The nature, principle and utility of this invention will become more apparent from the following detailed description and the appended claims when read in conjunction with the accompanying drawings, in which like parts are designed by like reference numerals.

DETAILED DESCRIPTION OF THE INVENTION

One preferred embodiment of the invention will be described with reference to the accompanying drawings.

Figure 1:
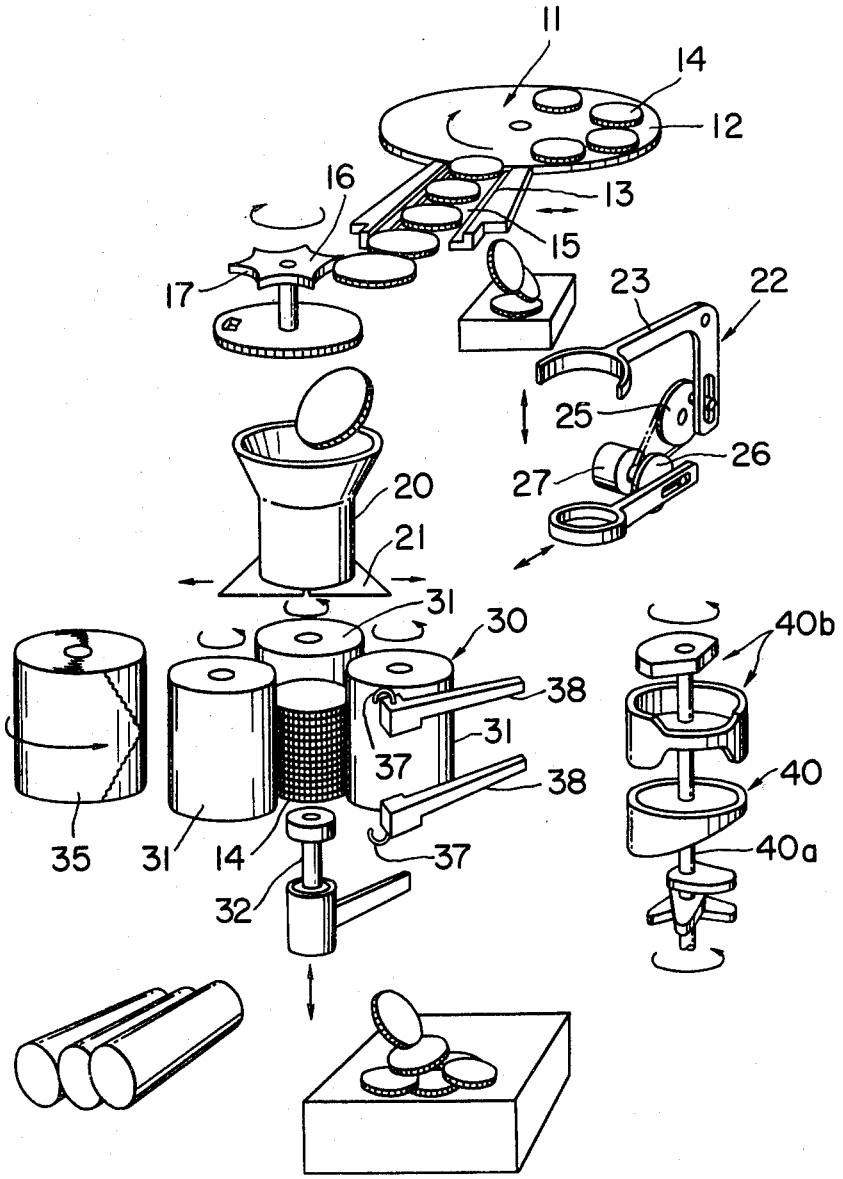
FIG. 1 is an exploded view illustrating an example of a coin packaging machine according to this invention.

Shown in FIG. 1 is a coin packaging machine comprising a coin supplying mechanism 11 made up of a rotary disk 12 and a coin sorting passageway 13 extended radially outwardly from the rotary disk 12. The rotary disk 12 is rotated to transfer the coins 14 on it to the passageway 13 by the centrifugal force thereof. A coin sorting groove 15 is provided in the coin sorting passageway 15. The width of the groove is predetermined to a certain value for sorting out coins of a desired denomination. Accordingly, coins whose diameters are smaller than this value are allowed to drop through the groove 15, while coins whose diameters are larger than the value are not allowed to enter the passageway 13. Thus, the coins of that desired denomination are allowed to pass through the passageway 13.

A counting star-wheel 16 is provided at the exit end of the coin sorting passageway 15. The star-wheel 16 has recessed portions 17 against which a coin passed through the passageway 15 is abutted to turn the star-wheel 16 through a predetermined angle, as result of which a pulse generating circuit (not shown) is operated to produce one count pulse.

Reference numeral 20 designates a coin stacking cylinder located below the exit end of the passageway 13 to receive the coins. The cylinder 20 has a shutter 21 at its bottom. The shutter 21 is operated to close and open the bottom of the cylinder 20 as desired. However, the bottom of the cylinder 20 is maintained closed by the shutter 21 when the coins coming out of the passageway 13 are stacked thereon to a predetermined number of pieces thereof.

The coin stacking cylinder 20 is provided with a vibrator means 22 for vibrating the cylinder 20. The vibrator means comprises a vertical vibration arm 23 for vertically vibrating the cylinder 20, and a horizontal vibration arm 24 for horizontally vibrating the cylinder 20. These arms are coupled to a driving motor 27 through eccentric cams 25 and 26.

Now, a coin packaging mechanism 30 of the machine will be described. A plurality of (three in FIG. 1) coin packaging rollers 31 are provided at equal intervals from one another. The predetermined number of stacked coins 14 are taken out of the coin stacking cylinder 20 by means of a coin supporting rod 32. The stack of coins thus taken out are clamped and rotated by the rollers 31. More specifically, at least one of the rollers 31 is movable sideward so that the stack of coins are clamped by the rollers 31. In addition, if at least one of the rollers 31 is driven to rotate, the remaining rollers 31 are rotated through the stack of coins 14, and and therefore all that is necessary for the remaining rollers 31 is to rotatably support the stack of coins 14. It goes without saying that it is possible to make all of the rollers 31 rotate. A wrapping paper 35 is wound around the stack of coins 14 as the rollers 31 rotate. Reference numeral 37 designated a pair of U-shaped crimping hooks which are secured to a pair of arms 38, respectively, in such a manner that the end portions of the hooks 37 confront each other. The pair of arms 38 are so designed that they are moved toward the stack of coins 14 through the gap between two adjacent rollers 31 and are so positioned that the crimping hooks 37 are above the upper peripheral edge of the stack of coin 14 and below the lower peripheral edge of the same 14, respectively. The distance between the arms 38 can be changed as required.

The aforementioned coin supporting rod is so designed as to move up and down through the space defined by the rollers 31. When the rod 32 reaches the shutter 21, the shutter 21 is opened so that the rod 32 introduces the stack of coins 14 into the space defined by the rollers 31.

In FIG. 1, reference 40 designates a packaging control section which controls the coin packaging mechanism 30 with the aid of cam **40*b* and its cam shaft 40*a*** driven by a motor (not shown).

Now, a theoretical construction of an incorrect coin stacking detecting device 41 incorporated in the coin stacking cylinder 20 will be described with reference to FIG. 2, which comprises positive terminal boards 42 and negative terminal boards 43, the boards 42 and 43 extending in the axial direction of the coin stacking cylinder 20 and being arranged alternately along a circumference, and insulators 44 interposed between the adjacent terminal boards 42 and 43. All of the positive terminal boards 42 are connected to a terminal 46 of the electric source (not shown), while all of the negative terminal boards 43 are connected to a terminal 47 of the same.

Figure 2:
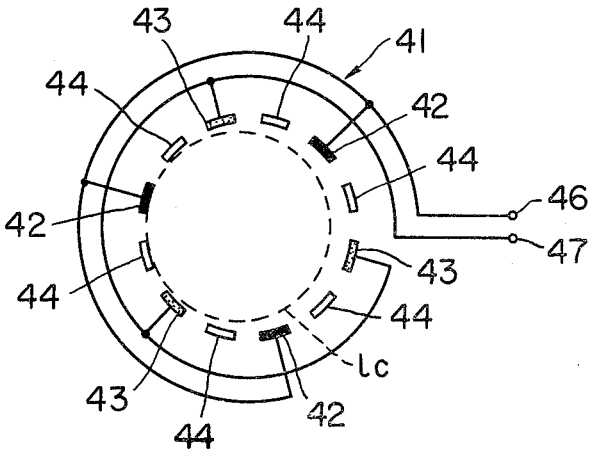
FIG. 2 is a diagram showing a theoretical construction of an incorrect coin stacking detecting device employed in the machine shown in FIG. 1.

In FIG. 2, the imaginary line lc is intended to designate the circumference of the coins stacked in the cylinder. If the centers of the coins stacked are coincident with one another, that is, all of the coins are correctly stacked, the terminal boards 42 and 43 will never be shorted by the stack of coins 14 as is clear from FIG. 2; however, if not, the terminal boards 42 and 43 will be shorted out by the stack of coins 14. Thus, the incorrect stacking state of the coins can be detected from this shorting of the terminal boards 42 and 43.

Figure 3:
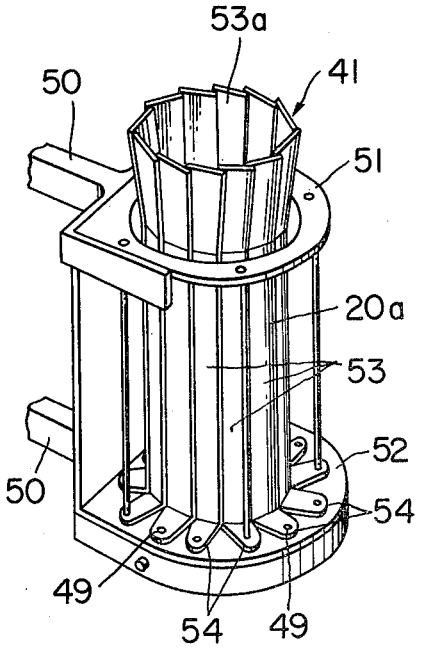
FIG. 3 is a perspective view showing one example of the incorrect coin stacking detecting device according to the invention.

FIG. 3 shows one example of the incorrect coin stacking detecting device 14 described above. A supporting frame 50, as shown in FIG. 3, supports a pair of upper and lower annular supporting plates 51 and 52. In FIG. 3, the terminal boards 42 and 43, and the insulators 44 are shown as elongated plates 53. These plates 53 are overlapped one on another to form a polygonal prism roughly similar to a cylinder. The polygonal prism thus formed is used as a coin stacking cylinder **20*a*. This cylinder 20*a* is inserted into the circular hole of the upper supporting plate 51, but covers the circular hole of the lower supporting plate 52. The upper end portions 53*a* of the elongated plates 53 are bent radially outwardly to form a conical section adapted to suitably receive coins which are successively delivered out of the coin sorting passageway. It should be noted that the elongated plates 53 can be displaced so that the inside diameter of the coin stacking cylinder 20*a* is changed as desired. Furthermore, each elongated plate 53 is, as shown in FIG. 3, bent outwardly to form a supporting member 54 which is rotatably supported by a pin 49 on the lower supporting plate 52. Accordingly, if the elongated plates 53 are turned cooperatively around the respective pins 49, the inside diameter of the cylinder 20*a* can be changed according to the diameter of coins to be packaged. In this connection, the whole of each elongated plate 53 may be the aforementioned positive terminal board 42 or negative terminal board 43 or insulator 44; however, a part of the elongated plate 53 may be the positive terminal board 42 or negative terminal board 43 or insulator 44**.

Figure 4:
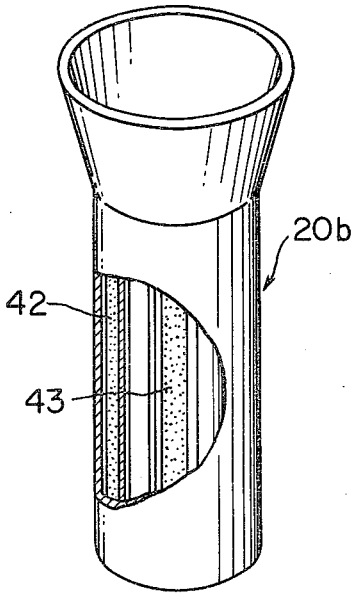
FIG. 4 is also a perspective view, with parts cut away, showing another example of the incorrect stacking detecting device.

Shown in FIG. 4 is a coin stacking cylinder **20*b* provided for a particular denomination. The cylinder 20*b* is made of insulating material, and the above-described positive and negative terminal boards 42 and 43** are juxtaposed at certain intervals on the inner wall of the cylinder.

Figure 5:
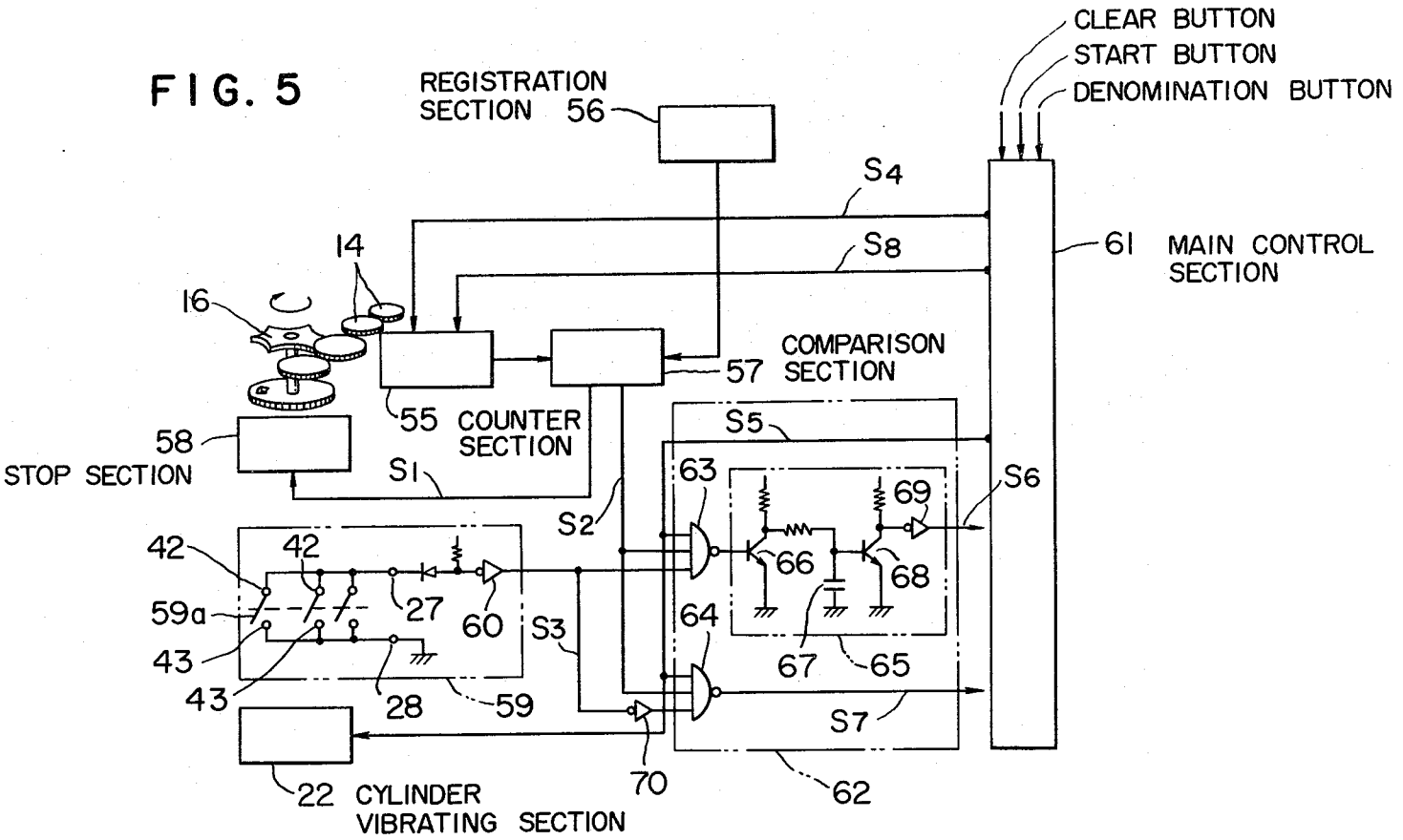
FIG. 5 is an electrical circuit diagram illustrating a control circuit employed in the coin packaging machine according to the invention.

A control circuit of this invention is shown in FIG. 5, which comprises: a counter section 55 which receives a count pulse produced whenever the star-wheel 16 is turned by a coin, and counts the number of coins 14 put into the stacking cylinder 20 (FIG. 1); a registration section 56 which registers a value to be counted by the counter section 55; that is, the number (50 for instance) of coins to be stacked in the coin stacking cylinder; and a comparison section 57 which compares the count value of the counter section 55 with the value set by the registration section 56. Upon coincidence of the two values, the comparison section 57 produces coincidence signals $S_1$ and $S_2$. The control circuit further comprises a stop section 58 which is operated by the coincidence signal $S_1$ from the comparison circuit 57 to forcibly stop the counting star-wheel 16 thereby to prevent the flow of coins 14 into the coin stacking cylinder 20; and an incorrect coin stacking detecting section 59 in which the relations between the positive and negative terminal boards 42 and 43 and the coins 14 are represented by normally-open contact means **59*a*. When at least one of the contact means 59*a* is closed, by the coin 14, the output of a NOT circuit 60** is raised to a "1" level which is outputted as an incorrect coin stacking detection signal.

A main control section 61 is to collectively control the coin packaging machine with the aid of command signals inputted thereto by operating a clear button, a denomination button, and a start button. For instance, the main control section operates: to apply to the counter section 55 a clear signal $S_4$ produced by operating the clear button, to clear the counter section; to set various operating sections to the denomination of coins selected by the denomination button; to rotate the rotary disk 12 in response to a start signal produced by operating the start button; and to produce a count step signal $S_5$ when the coins are counted and placed into the coin stacking cylinder 20; and to operate a cylinder vibrating section 22. Thus, the main control section 61 carries out a series of control operations.

In FIG. 5, reference numeral 62 designates a packaging operation instructing sections comprising first and second NAND circuits 63 and 64 and a timer circuit 65.

The first NAND circuit 63 receives the coincidence signal $S_2$ from the comparison circuit 57, the count step signal $S_5$ from the main control section 61, and an incorrect coin stacking detection signal $S_3$ from the incorrect coin stacking detecting section 59. Therefore, if the number of coins in the coin stacking cylinder 20 reaches the predetermined number of pieces thereof and an incorrect coin stacking occurs in the cylinder, all the input levels of the NAND circuit become "1," and an operating output "0" is provided thereby. This operating output "0" is applied to the timer circuit 65 and it is raised to the operating output "1" in a predetermined time, which is applied, as a trouble signal $S_6$, to the main control section 61. More specifically, the timer circuit 65 comprises: a transistor 66 which is rendered non-conductive when the output of the first NAND circuit 63 is at the "0" level; a capacitor 67 which is charged with a predetermined time constant when the transistor 66 is rendered non-conductive; a transistor 68 which is rendered conductive when the voltage of the capacitor 67 exceeds a predetermined value; and a NOT circuit 69 which produces a signal at the "1" level when the emitter voltage of the transistor 68 is at the "0" level. When as was described before, the trouble signal $S_6$ is applied to the main control section 61, the latter 61 produces a packaging operation inhibiting signal and provides a command signal for opening the shutter 21 (FIG. 1) to discharge the coins which have been incorrectly stacked.

The second NAND circuit 64 is equal to the first NAND circuit 63 except that the incorrect stacking detection signal $S_3$ is applied through the NOT circuit 70 thereto. Therefore, when the number of coins in the coin stacking cylinder 20 reaches the predetermined number of pieces thereof and the coins are correctly stacked, all of the input signals thereto are at the "1" level, as a result of which the operating output "0" is applied, as a packaging request signal $S_7$, to the aforementioned main control section 61. Upon reception of this packaging request signal $S_7$, the main control section 61 produces a packaging signal so as to cause the machine to carry out the series of packaging operations for the stacked coins. In this case, the packaging control section 40 is operated, and the series of packaging operations are carried out by the coin packaging mechanism 30 (FIG. 1). In addition, upon reception of the packaging request signal $S_7$, the main control section 61 operates to stop the production of the count step signal $S_5$ instructing the vibration of the cylinder. Upon start of the packaging operation, the main control section 61 provides a packaging confirmation signal. As a result, the counter section 55 is reset to start its operation for the next packaging operation, and simultaneously the main control section produces the above-described count step signal $S_5$ again.

When the start signal is issued by depressing the start button, the rotary disk 12 is rotated, and the coins 14 are allowed to drop into the coin stacking cylinder 20 through the coin sorting passageway 13 with the aid of the centrifugal force (FIG. 1). The counting star-wheel 16 detects the fact that the coins 14 have been placed in the cylinder 20, and applies the pulse signals to the counter section 55. On the other hand, the main control section 61 produces the count step signal to operate the cylinder vibrating section 22, as a result of which the coin stacking cylinder 20 is vibrated. Accordingly, the coins dropped into the cylinder 20 are correctly stacked one on another. However, if a deformed coin is included in the coins in the cylinder 20 for instance, sometimes the coins are not correctly stacked therein. If, when the predetermined number of coins have been placed in the cylinder 20, the centers of the coins are not coincident with one another or the aforementioned coin standing occurred, the positive and negative terminal boards 42 and 43 are shorted out by the coin or coins 14, as a result of which the incorrect coin stacking detecting section outputs the signal at the "1" level. Therefore, the first NAND circuit 63 produces the operating output "0" to start the timer circuit 65.

Since the vibration of the cylinder 20 is continued even for a delay time provided by the timer circuit, the incorrect coin stacking state is sometimes corrected. In this case, the first NAND circuit 63 produces the output "1." Therefore, the transistor 66 in the timer circuit 65 is rendered conductive, and the capacitor 67 is discharged, whereby the timer circuit 65 is reset. Simultaneously, the second NAND circuit 64 is operated to provide the output "0" as the packaging request signal $S_7$. Therefore, the packaging mechanism 30 (FIG. 1) is operated to package the stacked coins 14.

If the incorrect coin stacking state is not corrected even after the delay time of the timer circuit 65 has passed, the timer circuit 65 is operated to produce the output "1" as the trouble signal $S_6$. This trouble signal $S_6$ is applied to the main control section 61, as a result of which the section 61 operates to open the shutter 21 to discharge the coins which have been incorrectly stacked in the cylinder 20.

Figure 6:
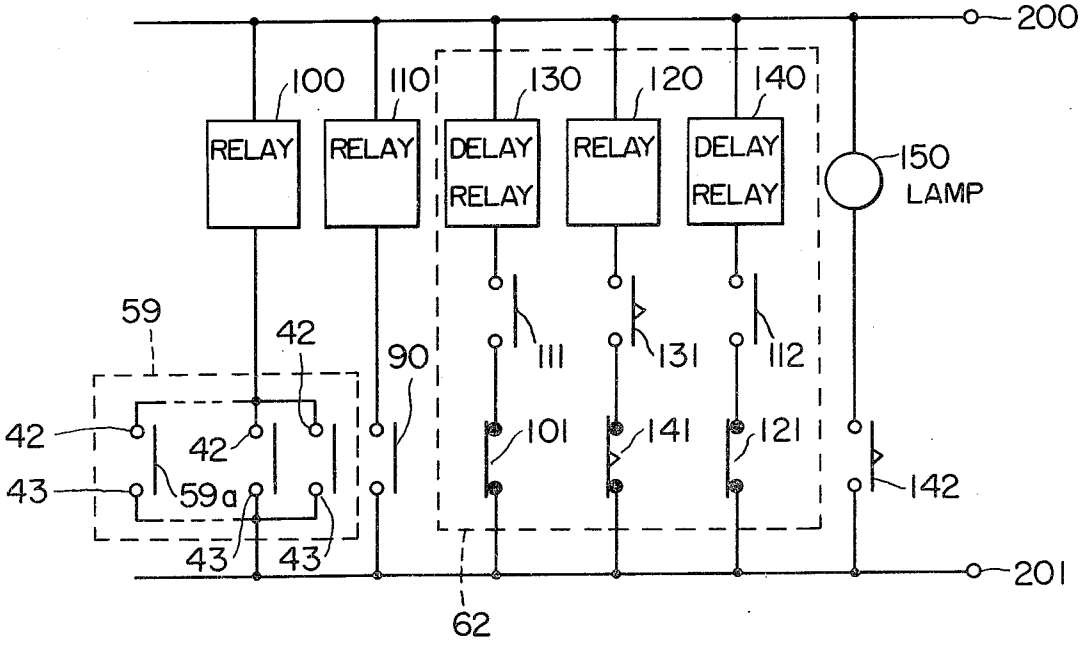
FIG. 6 shows an electrical connection diagram, partly as a block diagram, for providing a trouble signal and a packaging request signal employed in the control circuit shown in FIG. 5.

The above-described trouble signal $S_6$ and packaging request signal $S_7$ may be provided by a circuit shown in FIG. 6.

In this circuit, terminals 200 and 201 are connected to the electric source. Reference numeral 59 designates an incorrect coin stacking detecting section which is the same as that shown in FIG. 5; however the relationships between the positive and negative terminal boards 42 and 43 and the coins 14 described with reference to FIG. 2 are indicated by normally-closed contact means 59*a*. A normally-open contact means 90 is closed when the registered value coincides with the count value in the registration section 57 (FIG. 5).

A packaging operation instructing section 62 comprises delay relays 130 and 140 with respective contact means 131 and 141, a relay 120 with a contact means 121, contact means 111 and 112 of a relay 110 which is excited when the normally-open contact means 90 is closed, and a contact means 101 of a relay 100 which is excited when the normally-open contact means 59*a* of the incorrect stacking detecting section 59 are closed. An alarm lamp 150 is lighted when the contact means 142 of the delay relay 140 is closed. The trouble signal $S_6$ is obtained by the operation of the delay relay 140, and the packaging request signal $S_7$ is obtained by the excitation of the relay 120. However, these signals $S_6$ and $S_7$, and the count step signal $S_5$ instructing the cylinder vibration are not indicated in FIG. 6.

The delay relays 130 and 140 are of the on-delay type well known in the art, in which its armature is transferred when it is energized for a predetermined period of time. The predetermined period of time of the relay 140 is longer than that of the relay 130 in the circuit shown in FIG. 6.

In operation, when the predetermined number of coins are placed into the coin stacking cylinder 20 (FIG. 1), the coincidence signal is outputted by the comparison section 57 (FIG. 5), whereby the normally-open contact means 90 is closed, the relay 110 is energized, and its normally-open contact means 111 and 112 are closed. Upon closure of the contact means 112, the delay relay 140 is energized. Where the packaging request signal $S_7$ is not obtained within a period of time $T_1$, the armatures of the contact means 141 and 142 are transferred, and simultaneously the trouble signal $S_6$ (not indicated in FIG. 6) is produced. The aforementioned period of time $T_1$ is the period of time predetermined for the delay relay 140.

When the incorrect coin stacking detecting section 59 detects no incorrect stacking condition, the normally-open contact means **59*a* are maintained opened, and the relay 100 is not energized to keep its contact means 101 closed. Therefore, the delay relay 130 is energized. If this condition is continued for a period of time $T_2$, then the normally-open contact means 131 of the delay relay 130 is closed, and the relay 120 is therefore energized. The packaging request signal $S_7$ is obtained by the energization of the relay 120. The relation between $T_1$ and $T_2$ is represented as $T_1 > T_2$. That is, when the incorrect stacking detecting section 59 detects no incorrect stacking condition continuously for the period of time $T_2$ within the period of time $T_1$ after the predetermined number of coins have been placed in the coin stacking cylinder 20, the packaging request signal $S_7$ is obtained. In the case when the incorrect stacking detecting section 59 detects the incorrect stacking condition from the beginning, the relay 100 is energized to open its normally-closed contact means 101. As a result, the delay relay 130 is deenergized, and therefore the relay 120** is not energized and the trouble signal $S_6$ is outputted in the period of time $T_1$.

In the case where, although the incorrect stacking condition is detected, the deformation of the coin is not so serious or the extent of the coin standing is slight, the coins may be correctly stacked by the vibration of the coin stacking cylinder. If this condition lasts for the period of time $T_2$ before the period of time $T_1$ passes, the relay 120 is energized, and the packaging request signal $S_7$ is issued. The relays 120 and the delay relay 140 are interlocked with each other, and therefore the packaging request signal $S_7$ and the trouble signal $S_6$ are never produced at the same time.

The above-described incorrect coin stacking detecting device 41, as shown in FIG. 2, is so designed as to detect the stagger of each coin in the stack of coins. Therefore, the device 41 can detect an incorrect coin stacking condition which cannot be detected by the conventional detector which carries out its detection operation from the height of stacked coins. Therefore, the provision of the incorrect coin stacking detecting device 41 can substantially prevent a trouble that because of the incorrect stacking of coins, the stack of coins collapses while it is being introduced into the packaging mechanism or being packaged thereby. When coins of another denomination are to be packaged, the diameter of the coin stacking cylinder is changed slightly according to the diameter of the coins so as to detect the incorrect stacking condition thereof. Thus, according to the invention, the incorrect stacking condition of coins can be detected more positively and readily.

As is apparent from the above description, in the coin packaging machine in which after a pluralty of coins are stacked as required, the stack of coins is packaged with a wrapping paper, according to the invention the coin stacking cylinder is provided with a plurality of terminal board extended in the axial direction thereof, the terminal boards being arranged at equal intervals along the inner wall of the coin packaging cylinder in such a manner that adjacent terminal boards are opposite in polarity. Therefore, according to the invention, the incorrect stacking condition due to the stagger of a coin in the stack of coin can be detected, thus preventing troubles due to the incorrect coin stacking condition.

What is claimed is:

1. In a coin packaging machine in which after a predetermined number of coins fed into a coin stacking cylinder are stacked in a predetermined stacking state, a wrapping paper is wrapped around the coins thus stacked, the improvement comprising an incorrect coin stacking detecting device which comprises a coin stacking cylinder provided with a plurality of terminal boards electrically insulated from one another, said terminals being arranged along the inner wall of said coin stacking cylinder in such a manner that said terminal boards extend in the axial direction of said coin stacking cylinder and are connected to the positive and negative terminals of an electric source so that adjacent terminal boards are opposite in polarity.

2. An incorrect coin stacking detecting device as claimed in claim 1, in which a plurality of terminal boards are arranged along a circumference in such a manner that adjacent terminal boards are electrically insulated by an insulating board and are opposite in polarity to form a coin stacking cylinder, said terminal boards and insulating boards being displaceably supported so as to change the inside diameter of said coin stacking cylinder.

3. An incorrect coin stacking detecting device as claimed in claim 1, in which said coin stacking cylinder is made of an electrically insulating material, and said plurality of terminal boards are provided at equal intervals on the inner wall of said coin stacking cylinder in such a manner that adjacent terminal boards are opposite in polarity.

* * * * *